US007793363B1

(12) United States Patent
Meike

(10) Patent No.: US 7,793,363 B1
(45) Date of Patent: Sep. 14, 2010

(54) FLUSHING MECHANISM FOR TOILET

(76) Inventor: Donald L. Meike, 1916 Sussex Rd., Kaycee, WY (US) 82639

( * ) Notice: Subject to any disclaimer, the term of this patent is extended or adjusted under 35 U.S.C. 154(b) by 0 days.

(21) Appl. No.: 12/586,684

(22) Filed: Sep. 25, 2009

Related U.S. Application Data

(63) Continuation-in-part of application No. 12/214,475, filed on Jun. 20, 2008, now abandoned.

(51) Int. Cl.
*E03D 5/04* (2006.01)

(52) U.S. Cl. ..... 4/250; 4/249; 4/411; 4/246.5

(58) Field of Classification Search ..... 4/249, 4/250, 411, 246.5

See application file for complete search history.

(56) References Cited

U.S. PATENT DOCUMENTS

| | | | | | |
|---|---|---|---|---|---|
| 1,595,741 | A | * | 8/1926 | Sweeney | 4/250 |
| 3,056,142 | A | * | 10/1962 | Chin | 4/408 |
| 3,780,384 | A | * | 12/1973 | Rivelle | 4/367 |
| 4,007,499 | A | * | 2/1977 | Lin | 4/249 |
| 5,177,818 | A | * | 1/1993 | Tsai | 4/241 |

* cited by examiner

*Primary Examiner*—Gregory L Huson
*Assistant Examiner*—Karen Younkins

(57) ABSTRACT

An apparatus and method to assure that the lid of a toilet is always in the down position when the toilet is flushed. This will prevent the toilet lid being left in an open position. The apparatus comprises a mechanism for connecting the toilet lid to the flushing mechanism of a toilet so that the toilet lid must be in the down position for the toilet to be flushed.

19 Claims, 10 Drawing Sheets

FLUSHING MECHANISM FOR TOILET

RELATED APPLICATIONS

This application is a continuation-in-part of U.S. patent application Ser. No. 12/214,475 filed on Jun. 20, 2008 now abandoned.

BACKGROUND OF THE INVENTION

1. Field of the Invention

The present invention relates generally to toilets and, more particularly, is concerned with an apparatus and method for flushing a toilet.

2. Description of the Prior Art

Toilets have been described in the prior art. However, none of the prior art devices disclose the unique features of the present invention.

While these toilets may be suitable for the purposes for which they were designed, they would not be as suitable for the purposes of the present invention, as hereinafter described.

SUMMARY OF THE PRESENT INVENTION

The present invention discloses a mechanism to assure that the lid of a toilet is always in the down position when the toilet is flushed. This will prevent the toilet lid being left in an open position. The present invention comprises a mechanism for connecting the toilet lid to the flushing mechanism of a toilet so that the toilet lid must be in the down position for the toilet to be flushed.

An object of the present invention is to assure that the lid and/or, possibly, the seat of a toilet is always in the down position before the toilet can be flushed. A further object of the present invention is to assure that the toilet lid of a toilet cannot be left in the up position. A further object of the present invention is to provide an apparatus which can be relatively easily and simply manufactured and used. An additional object of the present invention is to provide a mechanism which can be manufactured on a new toilet or retrofit onto an existing toilet.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
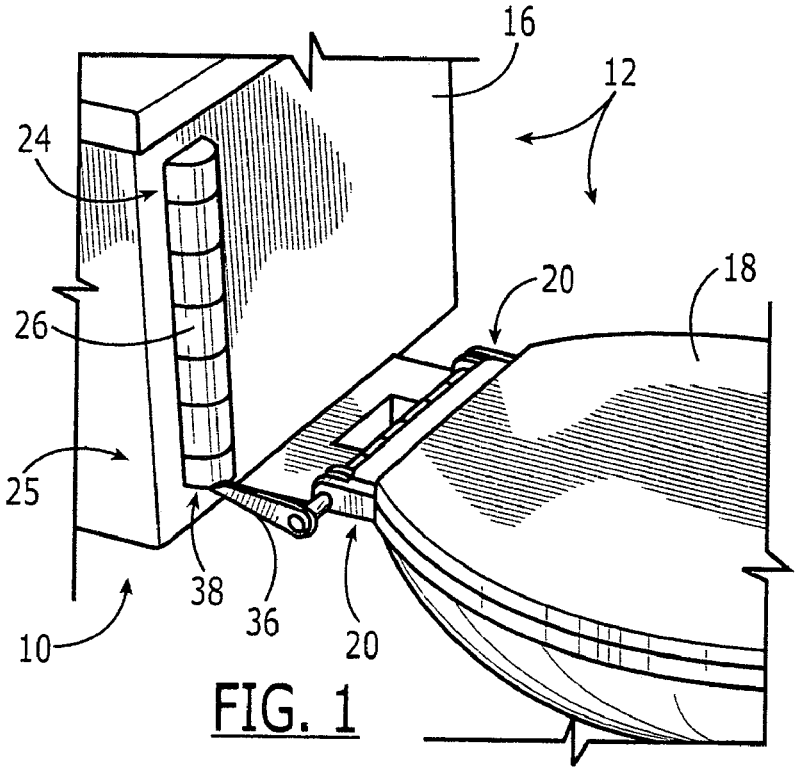
FIG. 1 is a perspective view of portions of the present invention.

With regard to reference numerals used, the following numbering is used throughout the drawings.

10 present invention
12 toilet
14 bowl
16 tank
18 lid/seat
20 lid attachment mechanism
22 lid axle
24 location of original flush handle
25 flushing mechanism
26 cosmetic cover
28 base of original toilet handle
29 scored edge
30 backplate
32 backplate
34 cover
35 trip pin
36 arm
38 lift shaft assembly
40 internal rod
41 upper mount
42 lower mount
43 wheel
44 mounting pin
45 pin
46 threaded rod
47 tapped tubing
50 mounting plate
51 flexible arm
52 threads
54 tip
56 split end
58 eccentric or cam portion
66 threads
68 tooth
70 arrow
72 arrow
74 lid
76 base
77 washer
78 arm
80 end of arm
82 end of arm
84 slot
86 guide arm

88 upright arm
90 coiled spring
92 receptacle
94 block
96 mounting arm
98 fastener
100 fastener
102 fastener
104 shoulder
105 protrusion
106 shoulder
108 base
109 end of spring
110 end of spring
112 inset edge

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 9 illustrate the present invention wherein a mechanism for flushing a toilet is disclosed.

Turning to FIG. 1, therein is shown the present invention 10 mounted on a conventional toilet 12 having a bowl, a tank 16, a seat/lid 18, and a mechanism 20 for pivotally attaching the rear of the lid to the rear upper portion of the bowl. Also shown is the flush arm axle 22 which is co-axial with the lid 18 attachment mechanism 20, connected to the rear mechanism 20 of the lid. Also shown is the original flush handle area/location 24 being replaced with a new flushing mechanism shown generally at 25 with arm 36 mounted on and extending from axle 22 to adjustable lift shaft 38 (not shown but see FIG. 3). A cosmetic plastic cover for protecting the flush mechanism is shown at 26.

Figure 2:
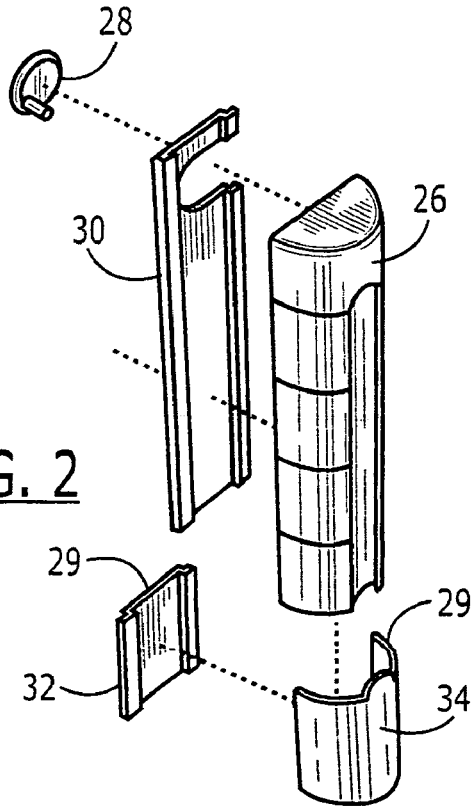
FIG. 2 is an exploded view of portions of the present invention.

Turning to FIG. 2, therein is shown a base 28 portion of the original toilet handle which is the remaining portion of the handle after the handle portion has been removed to accommodate the new flush mechanism of the present invention. Base 28 is disposed on the outer front surface of the tank 16 so that wheel 43 (not shown but see FIG. 5) can be adapted for attachment to base 28. Also shown is a cosmetic cover 26 which attaches to a back plate 30, which attaches to the front of the toilet tank with an adhesive pad or the like. A mounting plate 32 and cover 34 is also shown illustrating how lower pieces of backplate 30 and cover 26 can be broken along scored edges 29 for easy adaptation to different toilet sizes.

Figure 3:
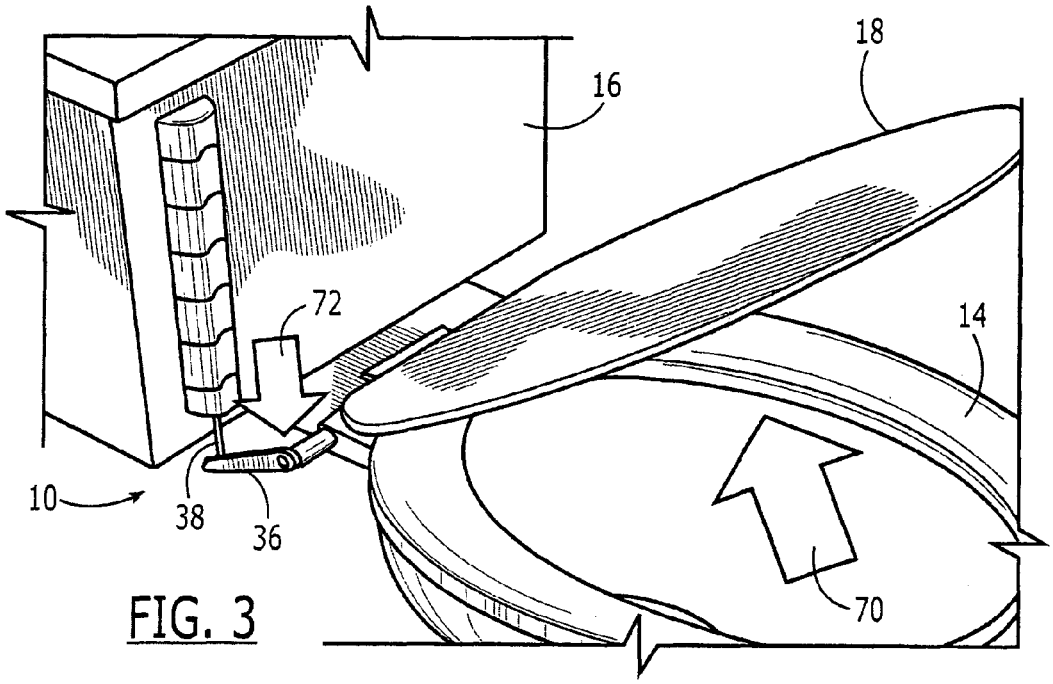
FIG. 3 is a perspective view of portions of the present invention.

Turning to FIG. 3, therein is shown the present invention 10 showing the lid 18 on the bowl 14 along with tank 16 showing how raising the lid 18 at arrow 70 lowers the lift shaft at arrow 72 of the flush mechanism. Arm 36 is also shown.

Figure 4:
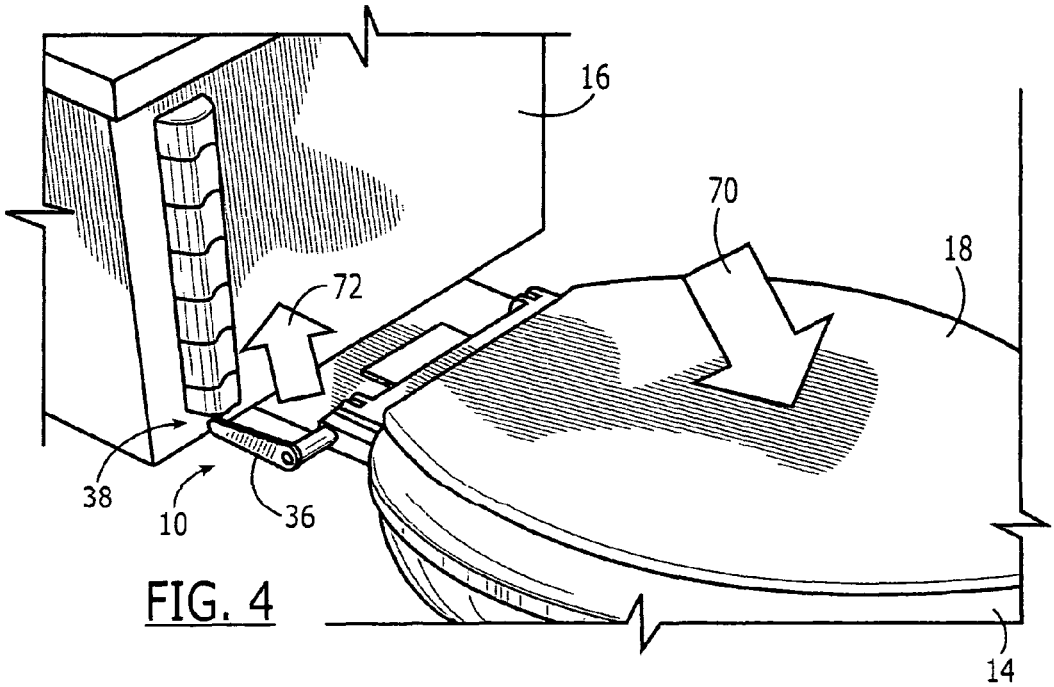
FIG. 4 is a perspective view of portions of the present invention.

Turning to FIG. 4, therein is shown the present invention 10 showing the lid 18 on the bowl 14 along with tank 16 showing how closing the lid 18 at arrow 70 raises the lift shaft 38 at arrow 72. Arm 36 is also shown.

Figure 5:
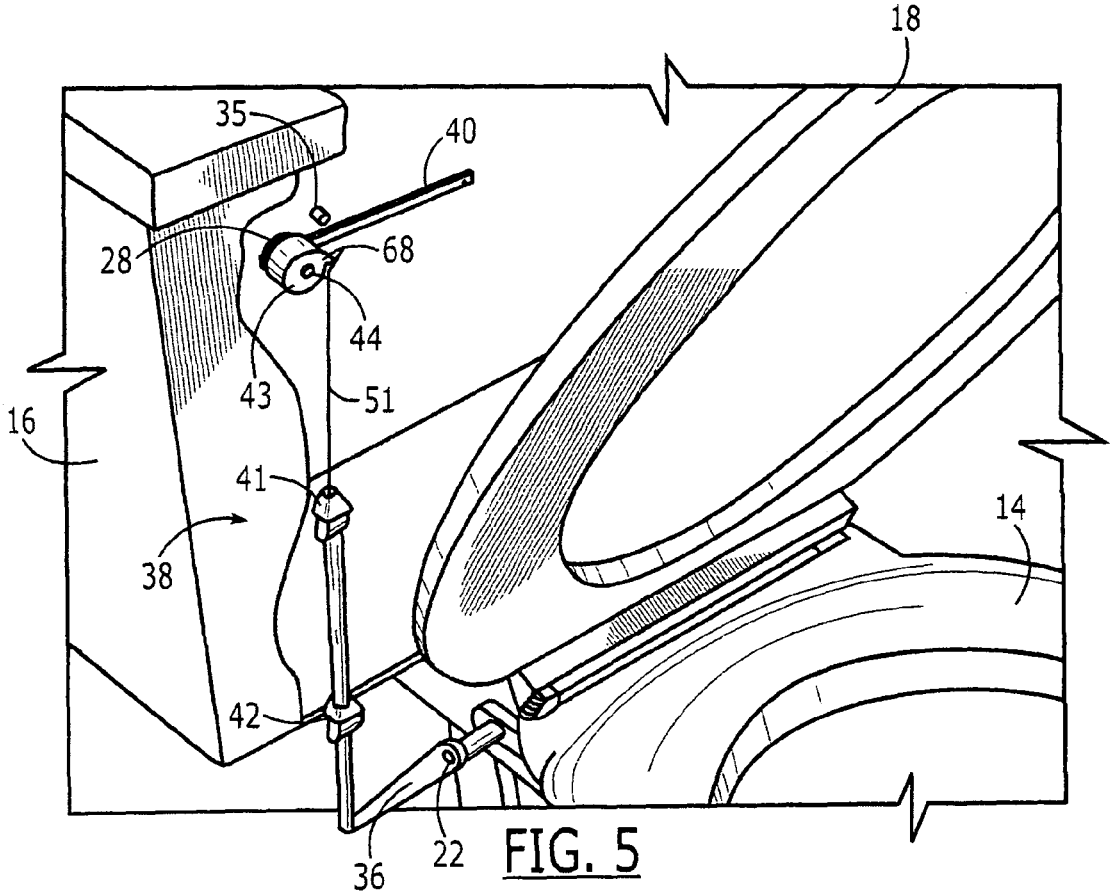
FIG. 5 is a cut-away perspective view of portions of the present invention.

Turning to FIG. 5, therein is shown the toilet bowl 14, lid 18, and tank 16 having an axle 22 connecting to the arm 36 which operates a lift shaft generally shown at 38 wherein the lift shaft is at its lower portion attached to the front of the tank using lower mount 42 and upper mount 41 and at its upper portion it has a flexible arm 51, which may be spring steel, which contacts a member 43, being an oval shaped wheel 43, mounted on a pin 44 having a tooth 68 thereon which wheel 43 is connected to the front base portion 28 of the original toilet handle. The operation of the internal toilet bowl flushing mechanism, i.e. rod 40, is not affected by attachment of the present invention. Also shown is trip pin 35.

Figure 6:
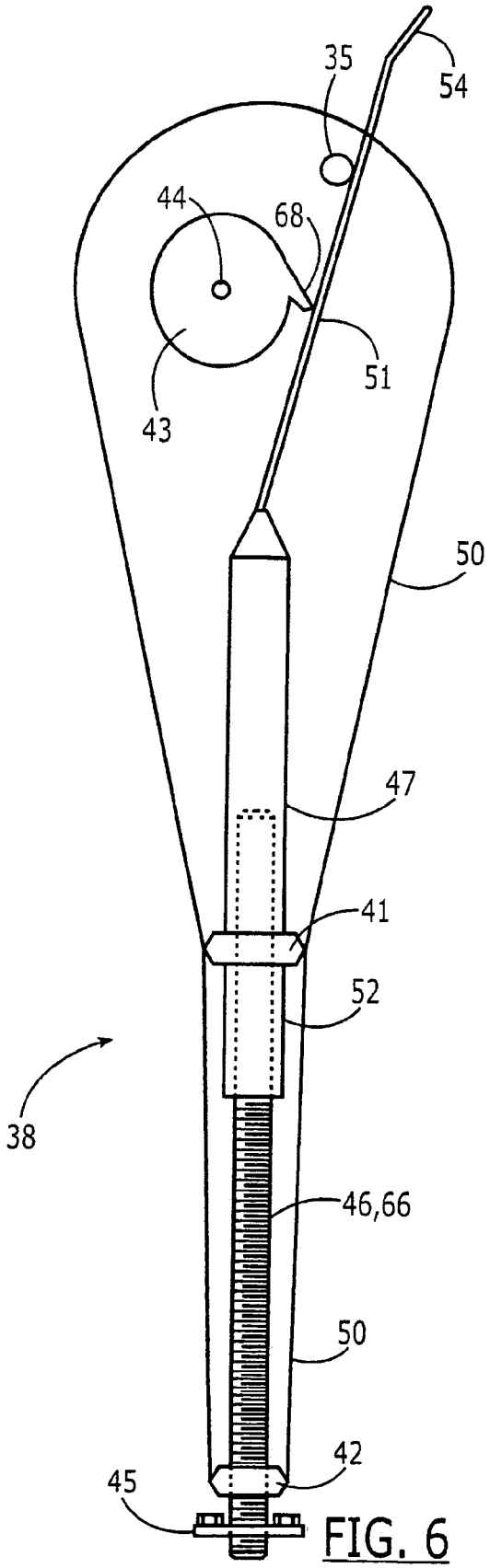
FIG. 6 is an elevation view of portions of the present invention.

Turning to FIG. 6, therein is shown the detailed design of the adjustable lift shaft assembly generally shown at 38 along with mounts 41, 42 comprising the threaded rod 46 with threads 66 thereon which is attached at its lower end to an arm 36 (not shown but see FIG. 5) with pin 45. The threaded rod 46 is inserted into tapped tubing 47 with mating internal threads 52 with the flexible spring steel extension arm 51 thereon. The length of lift shaft assembly 38 is adjustable by rotating rod 46 in tubing 47 so that the assembly can be adapted to fit on variously sized toilet tanks. The wheel 43 with tooth 68 is mounted on the pivot pin 44 which is connected to the internal rod 40 (not shown but see FIG. 5) which releases the water in the toilet tank for flushing when raised. A mounting plate 50 is inserted over pivot pin 44 and behind wheel 43 and has trip pin 35 mounted thereon. Extension arm 51 has an angled upper tip 54 which has an effective length and angle to contact trip pin 35 when rod 46 is raised.

Figure 6A:
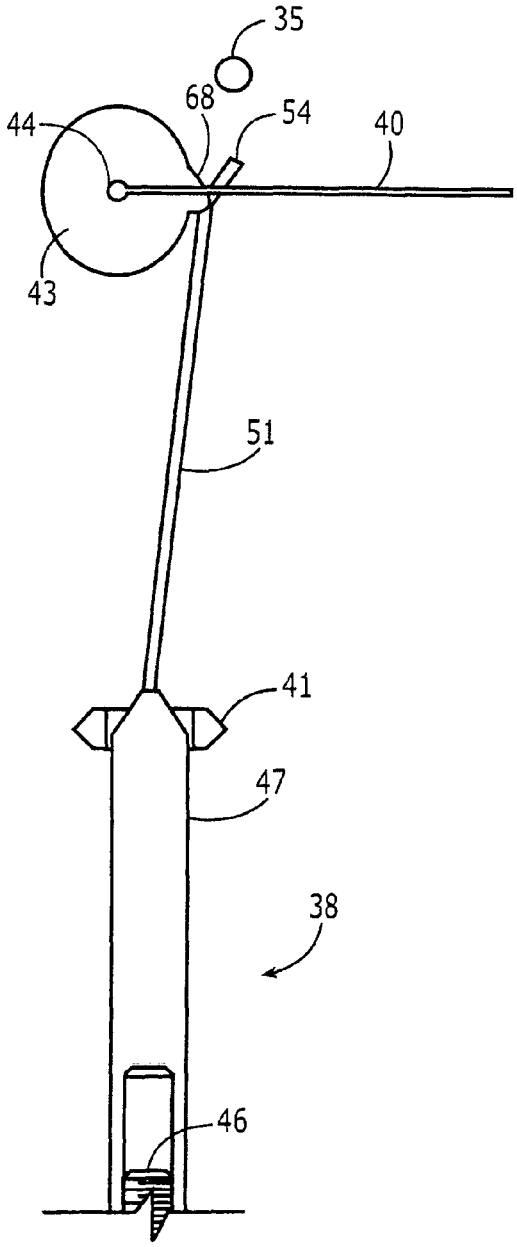
FIGS. 6A-6D show the operational steps of portions of the present invention.
Figure 6B:
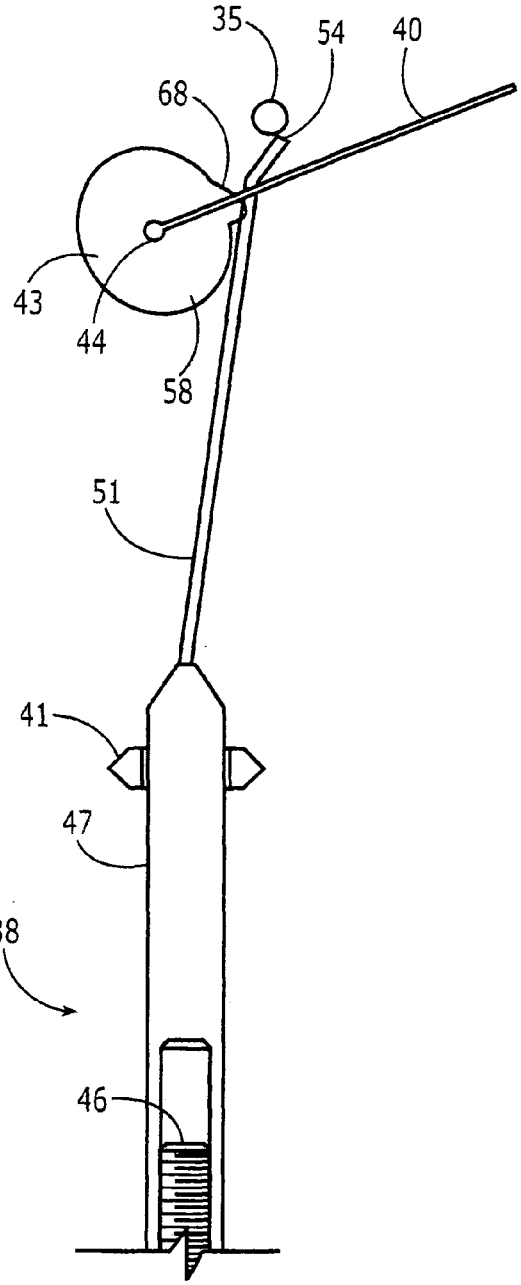
Figure 6C:
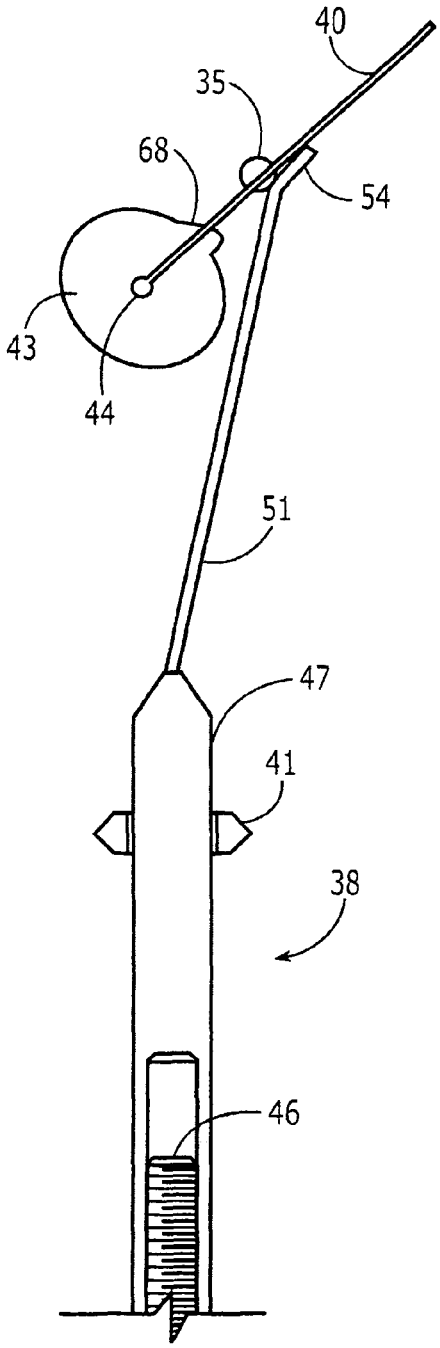
Figure 6D:
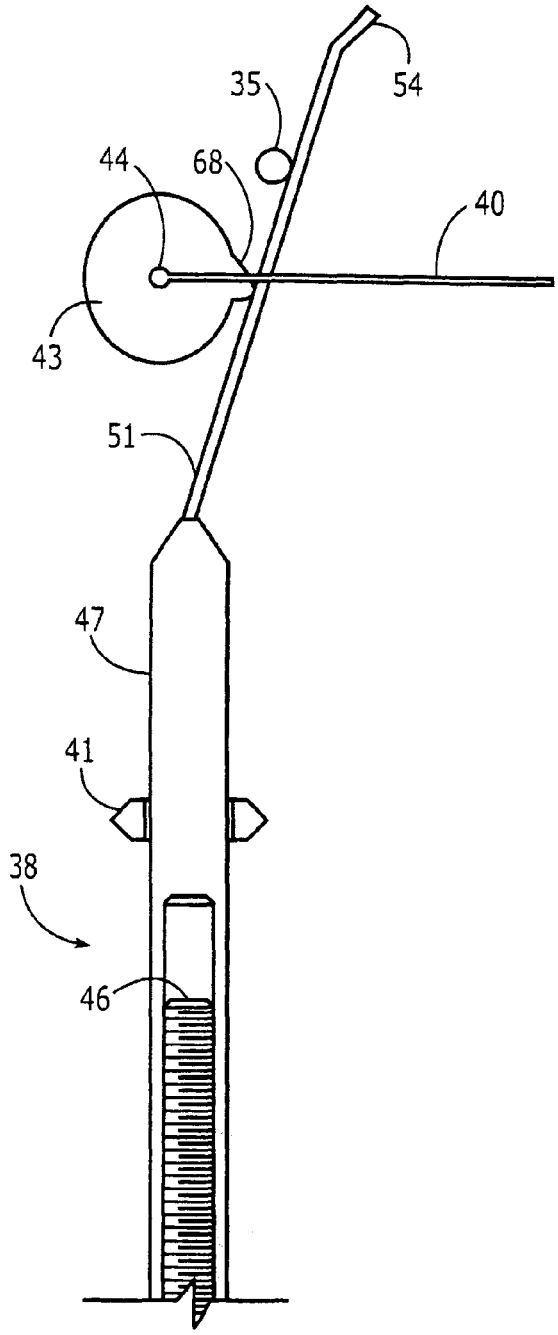

Turning to FIGS. 6A-6D, therein is shown the positions of the lift arm assembly generally shown at 38 during the sequence of operational steps required for flushing the toilet. FIG. 6A shows the position of the lift arm assembly 38 with the lid 18 (not shown but see FIG. 3) in the full up position ready for flushing. The spring steel extension 51 is secure below the tooth 68 on the wheel 43 with rod 40 being substantially horizontal. The internal flush mechanism is shown in the normally closed position with rod 40 being substantially horizontal to maintain sufficient flushing water inside the tank filled with water. FIG. 6B shows the lift arm assembly 38 raising and rotating wheel 43 counterclockwise as the lid 18 (not shown but see FIG. 3) is beginning to lower. The eccentric or cam portion 58 of wheel 43 with tooth 68 thereon contacts arm 51 moving/deflecting arm 51 away therefrom an effective distance to allow tip 54 to contact trip pin 35 as the internal flush rod 40 is being raised thereby allowing the toilet to flush. Arm 51 is effectively biased toward wheel 43. FIG. 6C shows the lift arm assembly 38 raising so that the tip 54 of arm 51 contacts the trip pin 35, further deflecting arm 51 away thus releasing the wheel 43 allowing it to rotate clockwise due to the torque caused by rod 40 allowing the internal flush rod 40 to lower to its normally lowered position and refill the toilet tank with water. FIG. 6D shows the lift arm assembly 38 in full up position when the toilet lid is in full lowered position and the toilet has been flushed with rod 40 returned to the horizontal position so that the tank can be re-filled with water. Other previously disclosed elements are also shown.

Figure 7:
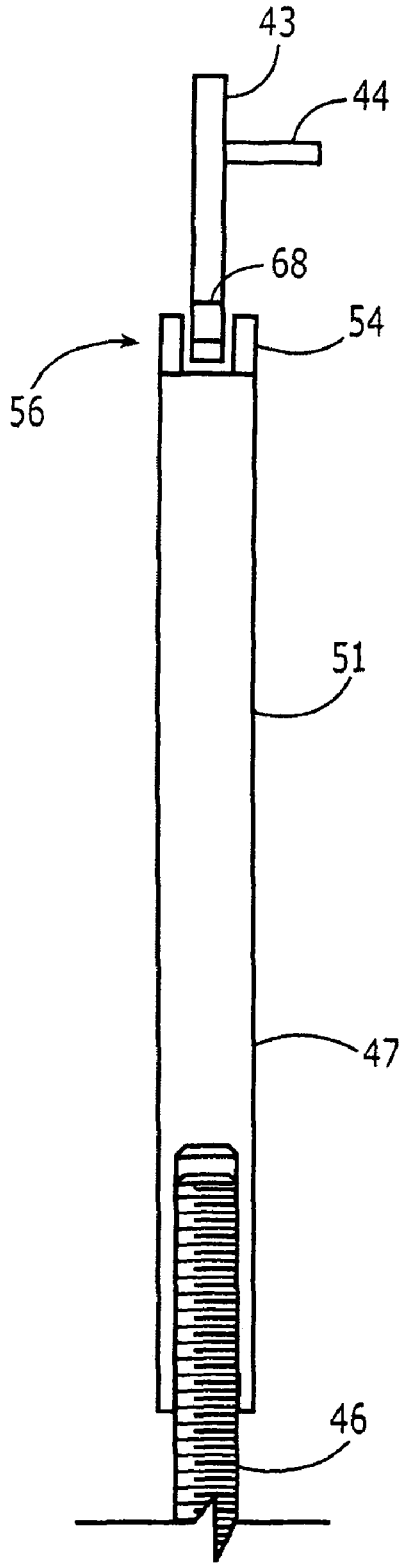
FIG. 7 is an elevation view of portions of the present invention.

Turning to FIG. 7, therein is shown a side view of the tapped tubing 47 with arm 51 thereon with a split end 56 at its upper tip 54 that allows it to engage the tooth 68 on the wheel 43 to accomplish the necessary steps of operation as previously disclosed. Other previously disclosed elements are also shown.

Figure 8:
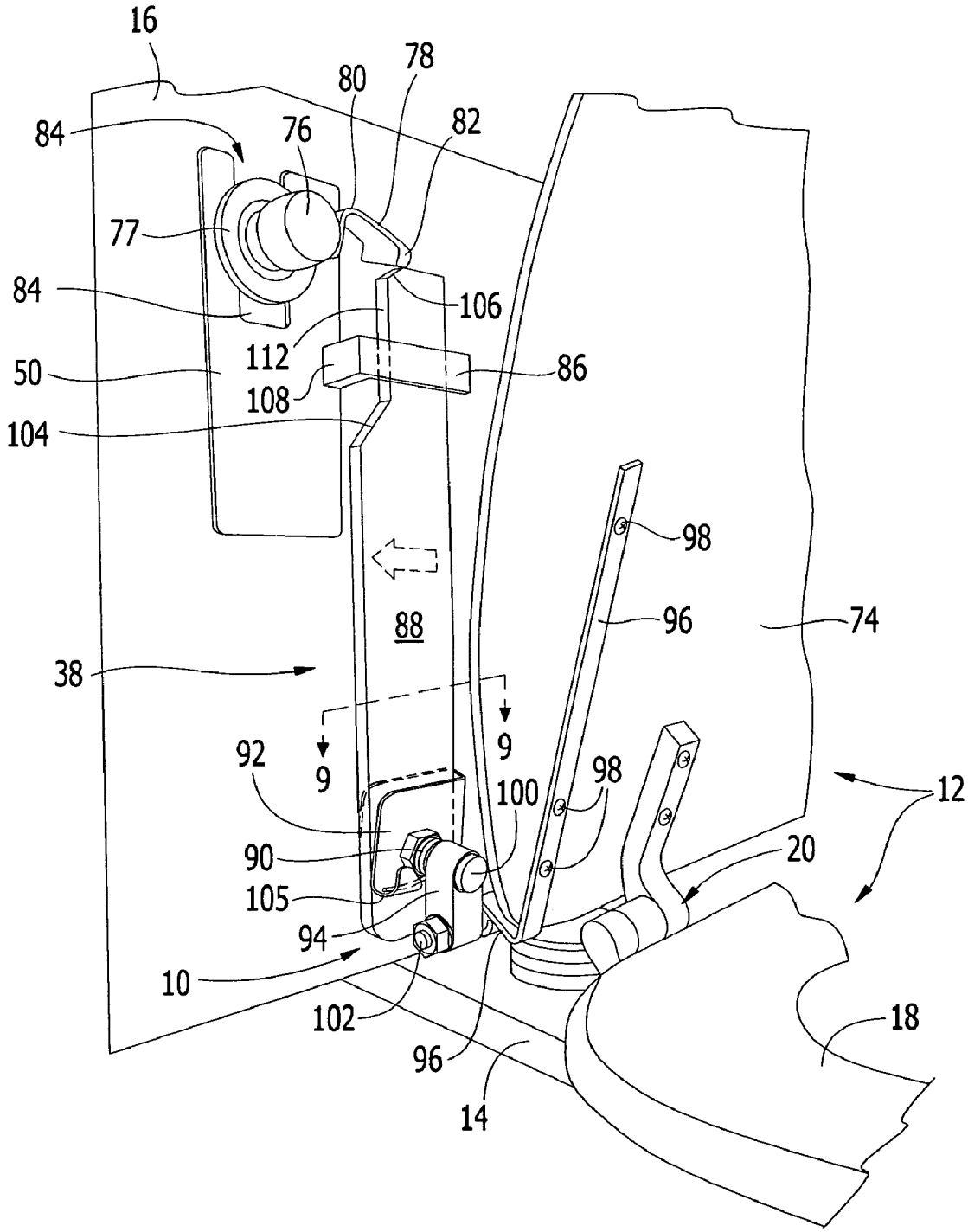
FIG. 8 is a perspective view of an alternative embodiment of the present invention.

Turning to FIG. 8, therein is shown the preferred embodiment of the present invention 10 mounted on a conventional toilet 12 having a bowl 14, a tank 16, a seat 18, a lid 74, and a mechanism 20 for pivotally attaching the rear of the lid to the seat and to the rear upper portion of the bowl in the conventional manner. Also shown is the base portion of the original flush handle 76 having attached thereto a member 78, being an arm 78, the arm having one end 80 attached to the side of base 76 and an end 82. Base portion 76 may be a shaft, pivot, or other suitable handle portion, depending on the type of toilet flush handle mechanism is installed on the toilet, to which arm 78 could be attached as would be done in the standard manner by one skilled in the art. End 80 of arm 78 is adapted for connection to the base 76, and, it is believed that end 80 of arm 78 may be attached to the base 76 using a fastener, e.g., a screw, double-sided tape, or adhesives. Also shown is the lift shaft assembly generally shown at 38. The base 76 is connected to the internal rod 40 (not shown but see FIGS. 8A-8D) which releases the water in the toilet tank for flushing when raised. A mounting plate 50 is inserted behind base 76 for securing the mounting plate to the front of tank 16; washer 77 is disposed between plate 50 and base 76. Mounting plate 50 has a slot 84 cut into its upper end so as to receive base 76 therein. Mounting plate 50 also has a catch member 86 thereon for guiding the upright standing arm 88. Upright arm 88 has upper and lower ends and is biased counterclockwise by spring 90. The end of guide arm 86 opposite its base 108 is spaced away from the face of tank 16 to provide a space within which arm 88 can move up, down, clockwise or counterclockwise and to keep arm 88 close to the tank 16 in a position to cooperate with arm 78. The lower end of arm 88 is mounted in a receptacle 92 mounted onto block 94 which block is attached to the rear of mounting arm 96 which is attached with fasteners 98, e.g., screws, to the underside of lid 74. A first fastener 100, e.g., a nut and bolt, is used to attach the receptacle 92 to block 94 and a second fastener 102, e.g., a nut and bolt, is used to attached the block 94 to the rear portion of mounting arm 96. Receptacle 92 is slightly rotatable about fastener 100 to accommodate the movement of arm 88 against the base 108 and the receptacle has a protrusion 105 thereon for receiving one end of coil spring 90 and the other end of the coiled spring contacts the inner side of block 94 so as to bias the receptacle and arm 88 held therein counterclockwise. The upper end of arm 88 has a cutout portion on its left side which forms a first shoulder 104, a second shoulder 106 and an inset edge 112. The first shoulder 104 slidingly contacts the base 108 of guide arm 86 and the second shoulder 106 slidingly contacts end 82 of arm 78. Shoulders 104 and 106 are effectively sized and angled for smooth operation of the lift shaft assembly 38. Arm 78 is effectively sized to cooperate with the upright arm 88.

Figure 8A:
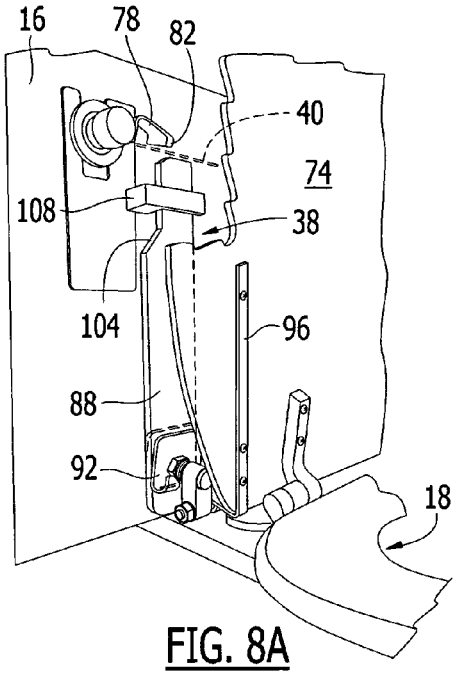
FIGS. 8A-8D show the operational steps of an alternative embodiment of the present invention.
Figure 8B:
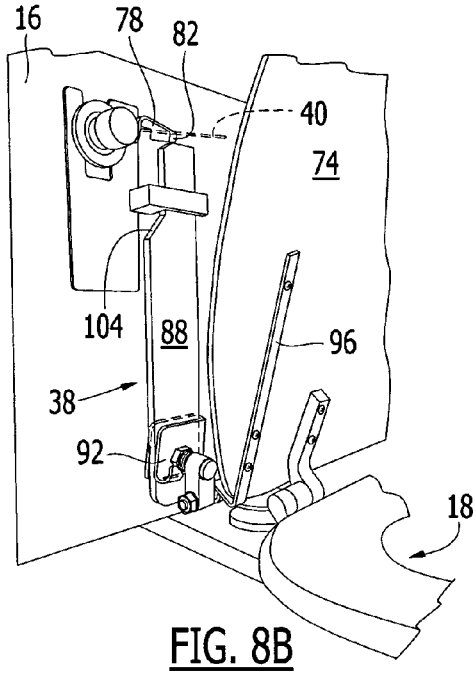
Figure 8C:
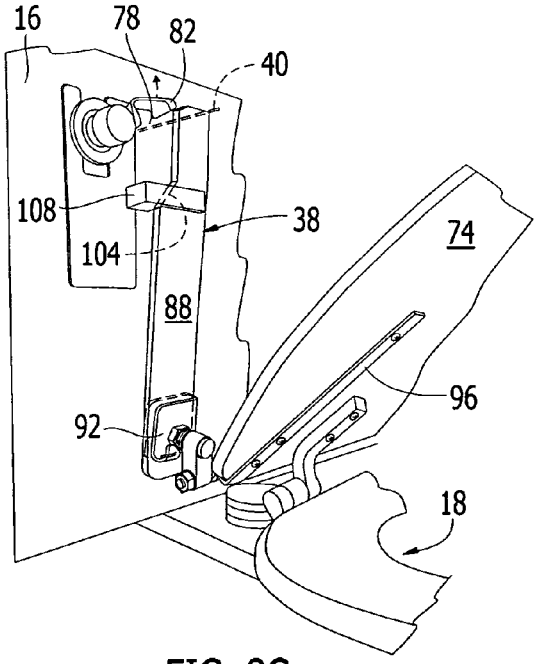
Figure 8D:
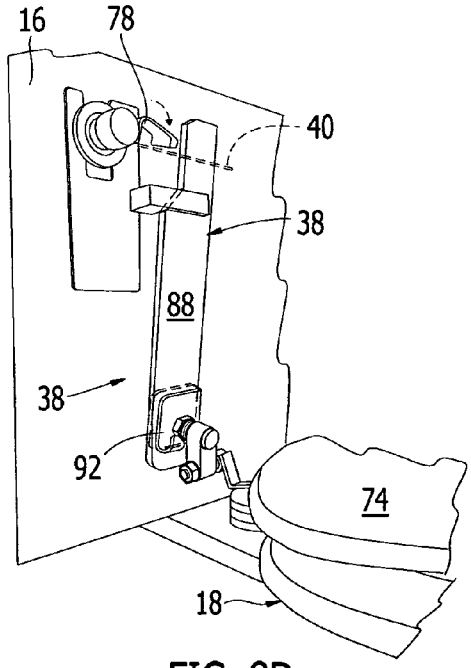

Turning to FIGS. 8A-8D, therein is shown the preferred embodiment showing the positions of the lift shaft assembly generally shown at 38 during the sequence of operational steps required for flushing the toilet. FIG. 8A shows the position of the lift arm assembly 38 with the lid 74 in the full up position ready for flushing. The upper end of arm 88 is below the end 82 of arm 78 being fully biased counterclockwise with shoulder 104 below base 108. The internal flush mechanism is shown in the normally closed position with rod 40 (shown in hidden line) being substantially horizontal to maintain sufficient flushing water inside the tank filled with water. FIG. 8B shows the lift shaft assembly 38 raising and rotating arm 78 counterclockwise as the lid 74 is beginning to lower. The end 82 of arm 78 contacts the upper end of arm 88 as the internal flush rod 40 is being raised thereby allowing the toilet to flush. Arm 88 is effectively biased toward arm 78. FIG. 8C shows the lift shaft assembly 38 raising as lid 74 is further lowered so that the base 108 contacts shoulder 104 forcing arm 88 away clockwise to a position to release the end 82 of arm 78 which will allow arm 78 to rotate clockwise due to the torque caused by rod 40 which will allow the internal flush rod 40 to lower to its normally lowered position and refill the toilet tank with water. FIG. 8D shows the lift shaft assembly 38 in full up position when the toilet lid 74 is in a nearly lowered position and the toilet has been flushed with rod 40 returned to the horizontal position so that the tank 16 can be re-filled with water. Other previously disclosed elements are also shown.

Figure 9:
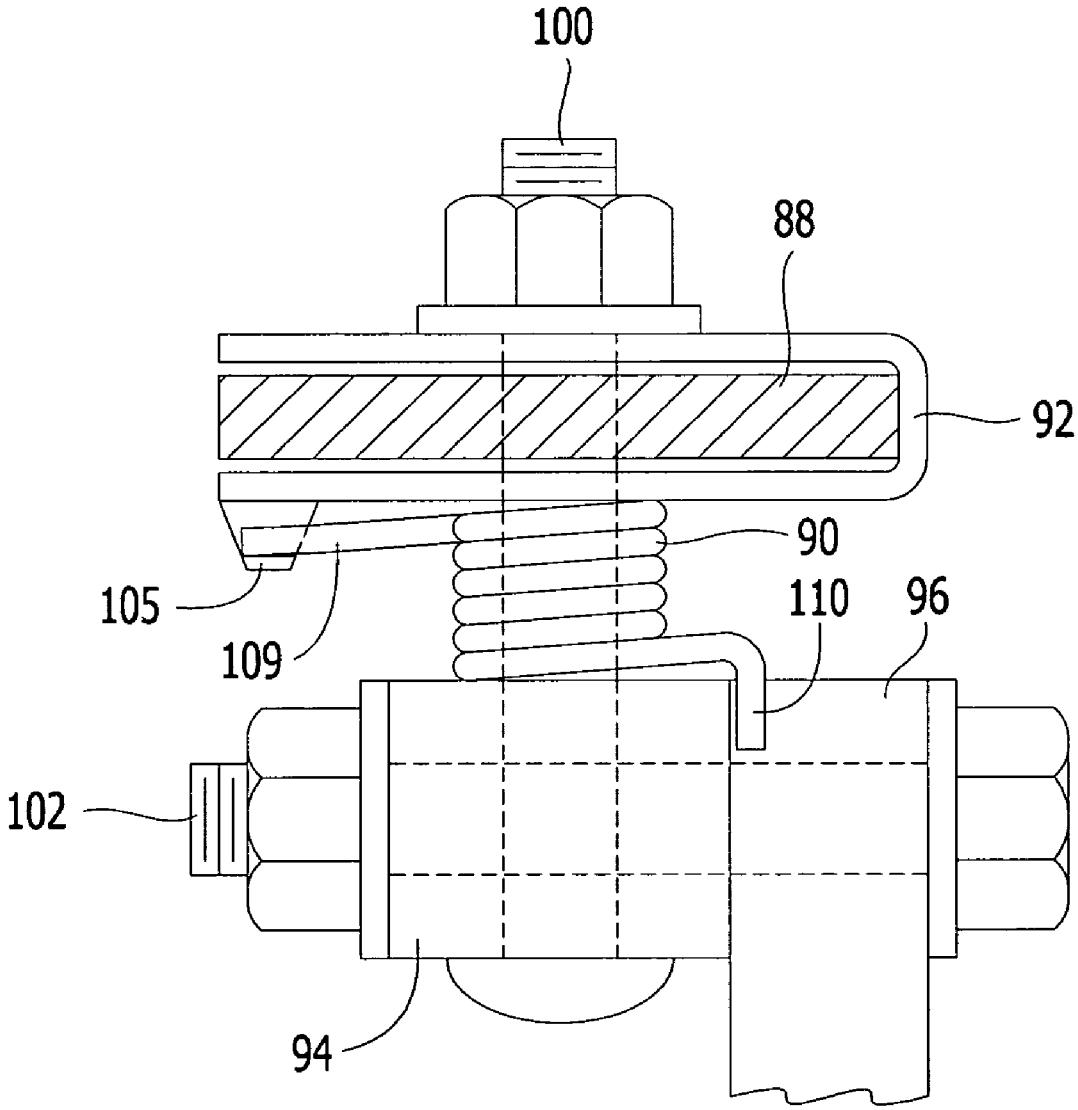
FIG. 9 is a cross-sectional view taken from FIG. 8 of an alternative embodiment of the present invention.

Turning to FIG. 9, therein is shown the preferred embodiment showing upright arm 88 in receptacle 92. The lower end of arm 88 is mounted in a receptacle 92 mounted onto block 94 which block is attached to the rear of mounting arm 96. A first fastener 100, e.g., a nut and bolt, is used to attach the receptacle 92 to block 94 and a second fastener 102, e.g., a nut and bolt, is used to attached the block 94 to the rear portion of mounting arm 96. Receptacle 92 is slightly rotatable about fastener 100 to accommodate the movement of arm 88 and the receptacle has a protrusion 105 thereon for receiving one end 109 of coil spring 90 and the other end 110 of the coiled spring contacts the inner side of block 94 so as to bias the receptacle and arm 88 held therein counterclockwise.

I claim:

1. An apparatus for flushing a toilet, comprising:

a) a toilet having a bowl, a tank, a lid, said tank having an internal flush mechanism therein and a front having an outer surface, said internal flush mechanism being in the normally closed position to maintain sufficient flushing water inside the tank, said lid having a rear, said bowl having a front and having an upper rear portion, wherein said rear of said lid is adapted for pivotal connection to said upper rear portion of said bowl so that said lid can be raised and lowered on said bowl, and a substantially horizontal axle being coextensive with said pivotal connection, said axle having a protruding end thereon;

b) a base of a toilet handle protruding through said front of said tank so as to be disposed on said outer front of said tank to permit the internal flush mechanism of the toilet to be operated when the base is rotated counterclockwise;

c) a wheel being disposed on said base to permit the base to be rotated counterclockwise when the wheel is rotated, said wheel having a cam portion, a tooth being disposed on said wheel;

d) a first arm having first and second ends, wherein said first end of said first arm is disposed on said protruding end of said axle so that said first arm rotates in substantially a vertical plane when said lid is raised or lowered; and, e) a lift shaft assembly having upper and lower ends being disposed on said outer front of said tank, wherein said lower end is adapted for connection to said second end of said first arm to permit the lift shaft assembly to be raised when the lid of the toilet is lowered, wherein said upper end is adapted for contacting said tooth of said wheel to permit the wheel and the base to be rotated counterclockwise so as to operate the internal flush mechanism of the toilet so as to flush the toilet when the lift shaft assembly is raised.

2. The apparatus of claim 1, wherein said lift shaft assembly comprises a lower threaded rod having upper and lower ends and an upper tapped tubing having upper and lower ends and internal mating threads, wherein said upper end of said lower threaded rod is threaded into said mating threads of said lower end of said tapped tubing wherein the length of said lift shaft assembly can be adjusted by rotating said lower threaded rod in said tapped tubing, wherein said lower end of said lower threaded rod is adapted for connection to said second end of said first arm to permit the lift shaft assembly to be raised when the lid of the toilet is lowered from a raised portion.

3. The apparatus of claim 2, further comprising a flexible arm having upper and lower ends, said flexible arm being biased toward said wheel, wherein said lower end of said flexible arm is disposed on said upper end of said tapped tubing and said upper end is adapted for contacting said tooth of said wheel to permit the wheel and the base to be rotated counterclockwise so as to operate the flush mechanism of the toilet so as to flush the toilet when the lift shaft assembly is raised.

4. The apparatus of claim 3, further comprising a mounting plate, said mounting plate having a hole therein, wherein said mounting plate is planar having front and rear surfaces and upper and lower ends, wherein said rear of said mounting plate is disposed contiguous to said outer front of said toilet tank, wherein said base of the toilet handle protrudes through said hole so as to be disposed on said front surface of said mounting plate so that said wheel can be disposed on said base, wherein said mounting plate is disposed between said front of said toilet and said wheel, wherein said lift shaft assembly is disposed on said front surface of said mounting plate, further comprising a trip pin being disposed on said front surface of said mounting plate proximate to said wheel.

5. The apparatus of claim 4, wherein said cam portion of said wheel contacts said flexible arm so as to deflect said flexible arm away therefrom as said wheel is rotated counterclockwise when the lift shaft assembly is raised.

6. The apparatus of claim 5, wherein said trip pin is disposed an effective distance from said wheel so that said upper end of said flexible arm contacts said trip pin so that said flexible arm is deflected away from said wheel when said lift shaft assembly is raised to permit the tooth of the wheel to disengage from the flexible arm so that the wheel and base can rotate clockwise to permit the flush mechanism of the toilet to return to its normal position.

7. A method for flushing a toilet comprising the steps of:

a) providing a toilet having a bowl, a tank, a lid and an internal flush mechanism therein which is in the normally closed position to maintain sufficient flush water inside the tank, the tank having an outer front, the lid having a rear, the bowl having a front and an upper rear portion, wherein the rear of the lid is adapted for pivotal connection to the upper rear portion of the bowl so that the lid can be raised and lowered on the bowl;

b) providing a base of a toilet handle protruding through the front of the tank so as to be disposed on the outer front of the bowl to permit the internal flush mechanism of the toilet to be operated when the base is rotated counterclockwise;

c) providing a member disposed on the base to permit the base to be rotated counterclockwise when the member is rotated, and;

d) providing a lift shaft assembly having upper and lower ends being disposed on the outer front of the tank, wherein the lower end is adapted for connection to the lid to permit the lift shaft assembly to be raised when the lid of the toilet is lowered, wherein the upper end is adapted for contacting said member of the base of the toilet handle to permit the member and the base to be rotated counterclockwise so as to operate the internal flush mechanism of the toilet so as to flush the toilet when the lift shaft assembly is raised.

8. The method of claim 7, further comprising the step of providing a substantially horizontal axle being coextensive with the pivotal connection, the axle having a protruding end thereon, wherein the member further comprises the step of providing a wheel disposed on the base so that the base is rotated counterclockwise when the wheel is rotated, the wheel having a cam portion, a tooth being disposed on the wheel, providing a first arm having first and second ends, wherein the first end of the first arm is disposed on the protruding end of the axle so that the first arm rotates in substantially a vertical plane when the lid is raised or lowered, wherein the lower end of the lift shaft assembly is adapted for connection to the second end of the first arm, wherein the upper end of the lift shaft assembly is adapted for contacting the tooth of the wheel, wherein the wherein the lift shaft assembly comprises a lower threaded rod having upper and lower ends and an upper tapped tubing having upper and lower ends and internal mating threads, wherein the upper end of the lower threaded rod is threaded into the mating threads of the lower end of the tapped tubing wherein the length of the lift shaft assembly can be adjusted by rotating the lower threaded rod in the tapped tubing, wherein the lower end of the lower threaded rod is adapted for connection to the second end of the first arm to permit the lift shaft assembly to be raised when the lid of the toilet is lowered from a raised position.

9. The method of claim 8, further comprising the step of providing a flexible arm having upper and lower ends, the flexible arm being biased toward the wheel, wherein the lower end of the flexible arm is disposed on the upper end of the tapped tubing and the upper end is adapted for contacting the tooth of the wheel to permit the wheel and the base to be rotated counterclockwise so as to operate the flush mechanism of the toilet so as to flush the toilet when the lift shaft assembly is raised.

10. The method of claim 9, further comprising the step of providing a mounting plate, the mounting plate having a hole therein, wherein the mounting plate is planar having front and rear surfaces and upper and lower ends, wherein the rear of the mounting plate is disposed contiguous to the outer front of the toilet tank, wherein the base of the toilet handle protrudes through said hole so as to be disposed on the front surface of the mounting plate so that said wheel can be disposed on said base, wherein the mounting plate is disposed between the front of the toilet and the wheel, wherein the lift shaft assembly is disposed on the front surface of the mounting plate, further comprising a trip pin being disposed on the front surface of the mounting plate proximate to the wheel.

11. The method of claim 10, wherein the cam portion of the wheel contacts the flexible arm so as to deflect the flexible arm away therefrom as the wheel is rotated counterclockwise when the lift shaft assembly is raised.

12. The method of claim 11, wherein the trip pin is disposed an effective distance from the wheel so that the upper end of the flexible arm contacts the trip pin so that the flexible arm is deflected away from the wheel when the lift shaft assembly is raised to permit the tooth of the wheel to disengage from the flexible arm so that the wheel and base can rotate clockwise to permit the flush mechanism of the toilet to return to its normal position.

13. The apparatus of claim 1, further comprising a cosmetic cover disposed so as to cover said base, said wheel and said lift shaft assembly.

14. The method of claim 7, further comprising the step of providing a cosmetic cover to cover the base, the member and the lift shaft assembly.

15. The method of claim 7, wherein the lift shaft assembly further comprises the step of providing an upright standing arm, wherein the upright standing arm is biased toward the member disposed on the base, wherein a portion of the upright standing arm moves counterclockwise so as to cooperate with the member disposed on the base so as to operate the flush mechanism of the toilet so as to flush the toilet when the lift shaft assembly is raised.

16. The method of claim 15, wherein the upright standing arm is biased toward the member by a coiled spring cooperating with the upright standing arm.

17. An apparatus for flushing a toilet, comprising:

a) a toilet having a bowl, a tank, a lid, said tank having an internal flush mechanism therein and a front having an outer surface, said internal flush mechanism being in the normally closed position to maintain sufficient flushing water inside the tank, said lid having a rear, said bowl having a front and having an upper rear portion, wherein said rear of said lid is adapted for pivotal connection to said upper rear portion of said bowl so that said lid can be raised and lowered on said bowl;

b) a base of a toilet handle protruding through said front of said tank so as to be disposed on said outer front of said tank to permit the internal flush mechanism of the toilet to be operated when the base is rotated counterclockwise;

c) a member being disposed on said base to permit the base to be rotated counterclockwise when the member is rotated, and;

d) a lift shaft assembly having upper and lower ends being disposed on said outer front of said tank, wherein said lower end is adapted for connection to said lid to permit the lift shaft assembly to be raised when the lid of the toilet is lowered, wherein said upper end is adapted for contacting said member of said base of said toilet handle to permit the member and the base to be rotated counterclockwise so as to operate the internal flush mechanism of the toilet so as to flush the toilet when the lift shaft assembly is raised.

18. The apparatus of claim 17, wherein said lift shaft assembly further comprises an upright standing arm, wherein said upright standing arm is biased toward said member disposed on said base, wherein a portion of said upright standing arm moves counterclockwise so as to cooperate with said member disposed on said base so as to operate the flush mechanism of the toilet so as to flush the toilet when said lift shaft assembly is raised.

19. The apparatus of claim 18, wherein said upright standing arm is biased toward said member by a coiled spring cooperating with said upright standing arm.

* * * * *